US009854364B2

(12) United States Patent
Clark et al.

(10) Patent No.: US 9,854,364 B2
(45) Date of Patent: Dec. 26, 2017

(54) KNURLED SPEAKER DIAPHRAGM

(71) Applicant: MrSpeakers LLC, San Diego, CA (US)

(72) Inventors: Daniel W. Clark, San Diego, CA (US); Frederick Bruce Thigpen, Tallahassee, FL (US); Robert Jason Egger, San Diego, CA (US)

(73) Assignee: MrSpeakers, LLC, San Diego, CA (US)

( * ) Notice: Subject to any disclaimer, the term of this patent is extended or adjusted under 35 U.S.C. 154(b) by 0 days.

(21) Appl. No.: 14/946,473

(22) Filed: Nov. 19, 2015

(65) Prior Publication Data

US 2016/0142824 A1 May 19, 2016

Related U.S. Application Data

(60) Provisional application No. 62/081,647, filed on Nov. 19, 2014.

(51) Int. Cl.

| | |
|---|---|
| ***H04R 9/06*** | (2006.01) |
| ***H04R 7/14*** | (2006.01) |
| ***H04R 7/04*** | (2006.01) |
| ***H04R 9/04*** | (2006.01) |
| *H04R 1/28* | (2006.01) |
| *H04R 1/10* | (2006.01) |
| *H04R 31/00* | (2006.01) |

(52) U.S. Cl.

CPC ..... *H04R 7/14* (2013.01); *H04R 7/04* (2013.01); *H04R 9/048* (2013.01); *H04R 1/1075* (2013.01); *H04R 1/2869* (2013.01); *H04R 9/047* (2013.01); *H04R 31/006* (2013.01); *H04R 2207/021* (2013.01); *H04R 2307/025* (2013.01)

(58) Field of Classification Search

CPC . H04R 7/04; H04R 7/06; H04R 9/025; H04R 9/06; H04R 9/047; H04R 9/048; H04R 11/02; H04R 13/00; H04R 2209/024; H04R 1/1075; H04R 1/2869; H04R 7/14; H04R 2207/021; H04R 2307/025

USPC ..... 381/176, 399, 408, 412, 421, 423, 424, 381/431; 181/157, 163, 164, 165, 167, 181/170

See application file for complete search history.

(56) References Cited

U.S. PATENT DOCUMENTS

| | | | | |
|---|---|---|---|---|
| 3,164,686 A * | 1/1965 | Tibbetts | H04R 9/047 181/170 |
| 3,389,226 A | 6/1968 | Peabody | |
| 4,337,379 A * | 6/1982 | Nakaya | H04R 9/047 381/408 |
| 6,008,714 A | 12/1999 | Okuda et al. | |
| 6,104,825 A * | 8/2000 | Thigpen | H04R 7/00 381/408 |
| 6,185,310 B1 | 2/2001 | Kermani et al. | |
| 6,810,126 B2 | 10/2004 | Levitsky | |
| 7,142,688 B2 | 11/2006 | Croft, III et al. | |

(Continued)

*Primary Examiner* — Huyen D Le

(74) *Attorney, Agent, or Firm* — Hall Estill Attorneys at Law; Tyler J. Mantooth

(57) ABSTRACT

A speaker may be configured with at least one diaphragm positioned proximal to and separated from an array of magnets. The diaphragm may consist of a substrate and at least one patterned electrically conductive trace with a portion of the diaphragm knurled to provide a ridge extending a height above the diaphragm that is at least twice a thickness of the diaphragm.

20 Claims, 5 Drawing Sheets

(56) References Cited

U.S. PATENT DOCUMENTS

| | | | |
|---|---|---|---|
| 8,774,430 | B2 | 7/2014 | Heed |
| 2004/0170296 | A1 | 9/2004 | Von Hellermann |
| 2008/0019558 | A1 | 1/2008 | Simidian, II et al. |

* cited by examiner

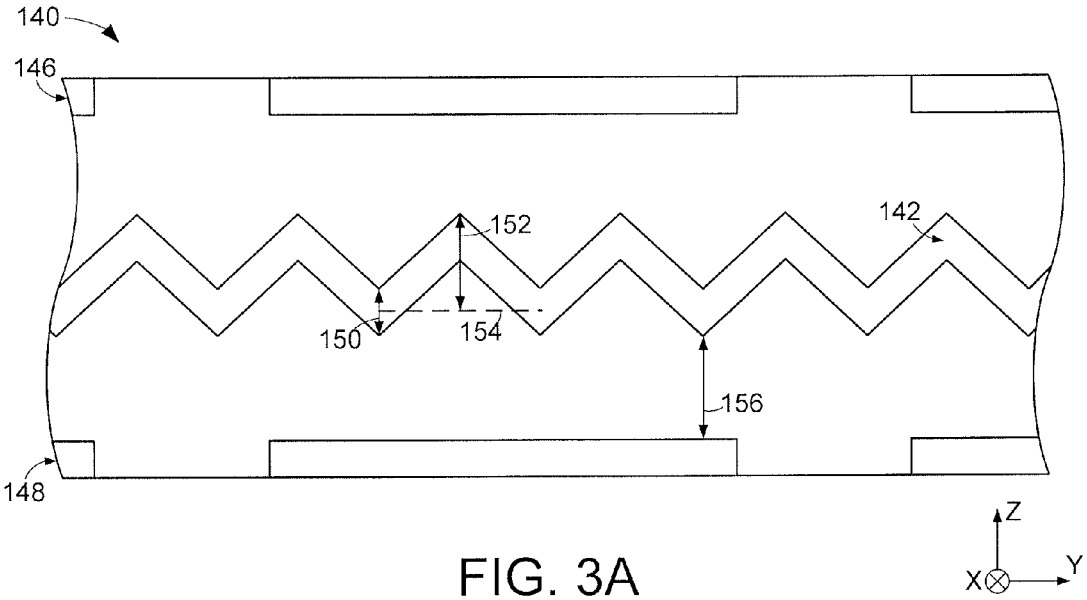
FIG. 3A
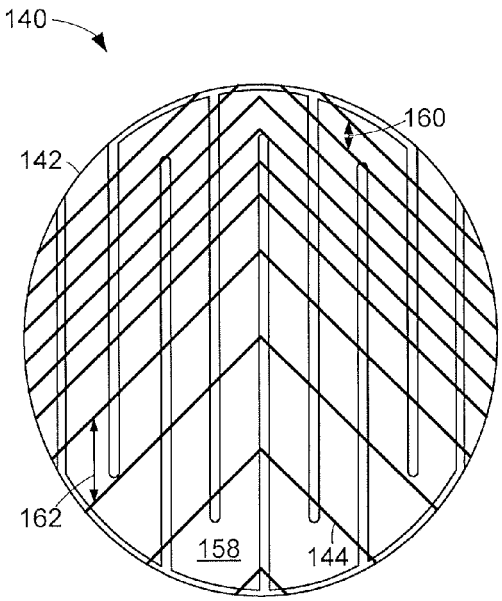
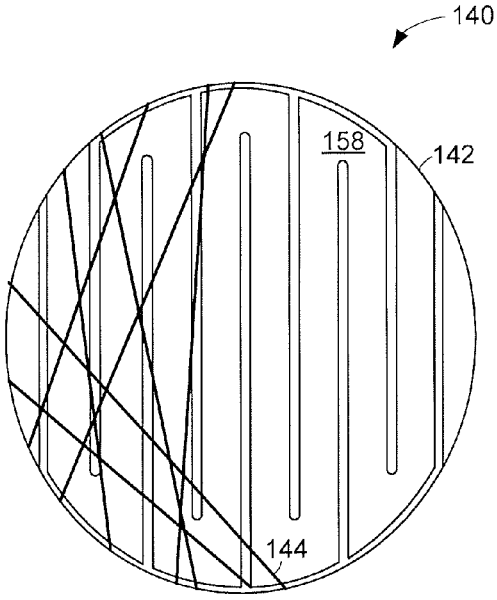
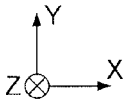
FIG. 3B
FIG. 3C
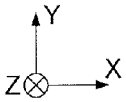

KNURLED SPEAKER DIAPHRAGM

RELATED APPLICATION

The present application makes a claim of domestic priority to U.S. Provisional Patent Application No. 62/081,647 filed Nov. 19, 2014, the contents of which are hereby incorporated by reference.

SUMMARY

A planar magnetic (magnetic planar) speaker, in accordance with some embodiments, has a diaphragm positioned proximal to and separated from an array of magnets with the diaphragm consisting of a substrate and at least one patterned electrically conductive trace. A portion of the diaphragm is knurled to provide a ridge extending a height above the diaphragm that is at least twice a thickness of the diaphragm.

BRIEF DESCRIPTION OF THE DRAWINGS

FIGS. 3A-3E respectively display different views of a portions of an example speaker constructed and operated in accordance with various embodiments FIGS. 4A & 4B respectively depict line representations of different portions of an example knurling device configured in accordance with assorted embodiments.

DETAILED DESCRIPTION

Figure 1:
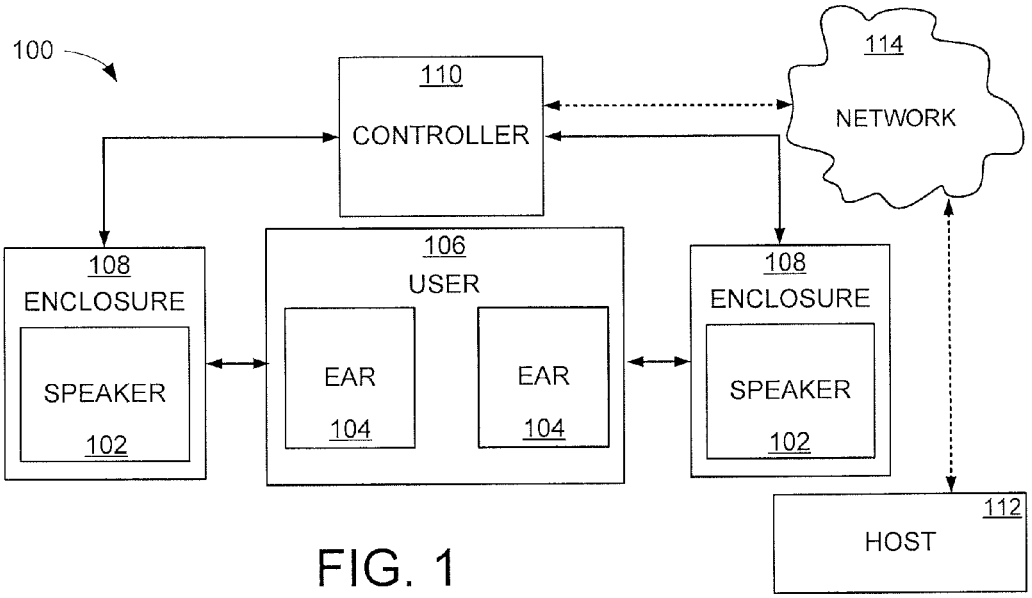
FIG. 1 is a block representation of an example audio system arranged in accordance with various embodiments.

The proliferation of digital audio sources has increased the exposure of various types of music. For example, mobile computing devices, such as smartphones, music players, and hard drives, can provide music on demand anywhere in the world. The increase in music exposure correlates with heightened industry and consumer demand for optimal music reproducing equipment that is portable. While relatively non-portable audio equipment, such as floor standing speakers, are unhampered by size and power restrictions, configuring a portable audio speaker with accurate and rugged quality despite reduced power supplies is difficult.

In the past, various types of audio speakers have been utilized individually and in combination to provide sufficient range and balance for music reproduction. For instance, a dynamic driver can be utilized concurrently with electrostatic and/or ribbon drivers to separately reproduce predetermined ranges of audio frequencies. However, such multi-driver configuration is not practical in portable audio devices, like headphones, due at least to size and power requirements. The use of planar magnetic drivers has indicated promising portable audio device operation, but can be hampered by standing waves on the driver panel and inaccurate dampening that degrades accurate reproduction of audio signals.

With these issues and others in mind, a planar magnetic speaker is arranged with a diaphragm knurled to provide at least one ridge extending a height above the diaphragm that is at least twice the thickness of the diaphragm. Typically, the velocity of a sound wave in a diaphragm substrate is low relative to the velocity of sound in a conductor material portion of a diaphragm. The density of the conductor material is usually higher than the substrate material and the compliance of the substrate material is high relative to favorable conductor materials. Through the frequency range of interest, such as audible frequencies, the combination of mechanical properties can allow multiple localized resonance modes to occur on the surface of the diaphragm causing distortion and frequency response variations.

Resonant modes can result from localized wave reflections on the surface of the diaphragm or the supporting frame. Knurling decreases the transverse velocity of sound in the conductor and significantly raises its compliance relative to the substrate, which reduces abridges resonance areas on the surface of the diaphragm. The low compliance of some conductor materials, such as Cu, results in a higher than desired natural frequency for a small area planar magnetic transducer. Knurling of the conductor material raises the mechanical compliance of the conductor, which allows a lower natural frequency for a given diaphragm tension.

Thus, tuning the diaphragm material and knurled ridges allows resonance and dampening to be controlled, which results in optimized audio signal reproduction by reducing distortion and improving the transient and frequency response of the system. Knurling the diaphragm also lowers the panel resonance frequency, so smaller panels can produce increased bass output. The ability to knurl the diaphragm with patterns of multiple ridges of similar, or dissimilar, shapes and sizes allows the planar magnetic speaker to be customized for a variety of different enclosures and types of sound being reproduced.

FIG. 1 is a block representation of an example audio system 100 that may employ one or more knurled planar magnetic speakers 102 in accordance with some embodiments. As shown, at least one speaker 102 is positioned proximal to each ear 104 of a user 106. The speakers 102 are housed in a headphone enclosure 108 that can be manipulated for fitment onto the user 106. The headphone enclosure 108 may consist of one or more local controllers 110, such as a microprocessor or application specific integrated circuit (ASIC), that directs audio reproduction by the speakers 102. The controller 110 can be connected to any number of other local electrical components, such as amplifiers, capacitors, and memories, which enable the headphone enclosure 108 to provide mono and stereo audio generation from at least one audio signal source.

In some embodiments, the local controller 110 is connected to one or more remote hosts 112 via a wired or wireless network 114. The ability to access remote hosts 112, such as other controllers, nodes, servers, and software, can provide audio signals that are not stored proximal to the speakers 102. As a non-limiting example, the user 106 may connect the headphone enclosure 108 to a local controller 110 resident in a smartphone that communicates with at least one remote host 112 to generate audio signals that are fed to and reproduced by the speakers 102. Hence, the connectivity and robust computing capabilities of the audio system 100 allows for the speakers 102 to receive and reproduce diverse varieties of sound, such as spoken word and music.

Figure 2A:
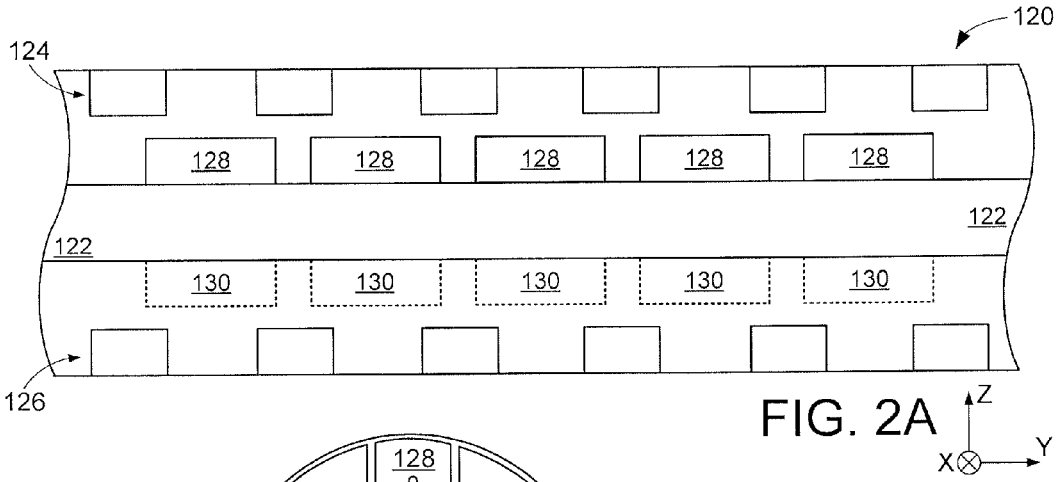
FIGS. 2A & 2B respectively show line representations of various portions of an example speaker configured in accordance with some embodiments.
Figure 2B:
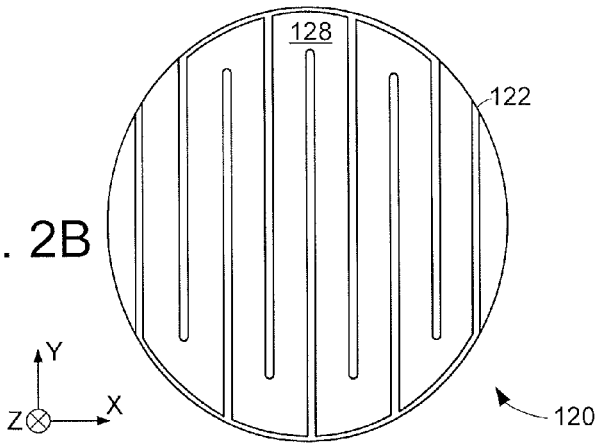

FIGS. 2A and 2B respectively provide different view line representations of portions of an example planar magnetic speaker 120 configured in accordance with various embodiments. In FIG. 2A, the speaker 120 is shown as a flexible diaphragm 122 suspended between first 124 and second 126 arrays of magnets. The magnets can be any size, shape, and material to interact with electrical signals passing through the voice coil trace 128 of the diaphragm 122. The diaphragm 122, in some embodiments, is an insulating material, such as polyethylene terephthalate (PET), and the trace 128 is a continuous pattern of non-magnetic and electrically conductive material, such as aluminum, as shown in FIG. 2B. It is contemplated that the electrically conductive trace 128 is positioned on a single side of the diaphragm 122, as shown in FIG. 2A, or on opposite sides of the diaphragm 122, as illustrated by segmented traces 130

The placement of the voice coil trace 128 relative to the magnet arrays 124 and 126 allows audio signals to interact with the magnetic fields of the magnets to flex the diaphragm 122 and produce vibrations in a wide range of frequencies, such as 0.1-20 kHz. However, the relatively large surface area of the diaphragm 122 along with the strong magnetic fields and the physical presence of the magnet arrays 124 and 126 can result in standing waves, unwanted distortion, and negative pressure regions during and after audio signal reproduction that degrade audio quality. These audio quality inhibitors can, at least partially, be attributed to uncontrolled flexibility of the diaphragm 122 in response to received audio signals. It is noted that a single continuous trace 128 is positioned on the diaphragm 122, but such configuration is not required or limiting as any number of separate traces, such as 2-5 traces, can increase the motor force on the diaphragm 122 compared to the single trace 128 embodiment of FIG. 2B.

Although various diaphragm 122 configurations can crease, emboss, and pleat portions of the diaphragm 122 to control flexibility, the power handling capability, thermodynamic properties, and audio reproducing accuracy can remain volatile at the expense of audio quality. Hence, assorted embodiments construct the diaphragm 122 with a configuration that allows more aggressive knurled ridges to be incorporated to tune the tension of the diaphragm 122 to optimize sound reproduction without materially inhibiting or changing electrical and thermal conductance.

Figure 3D:
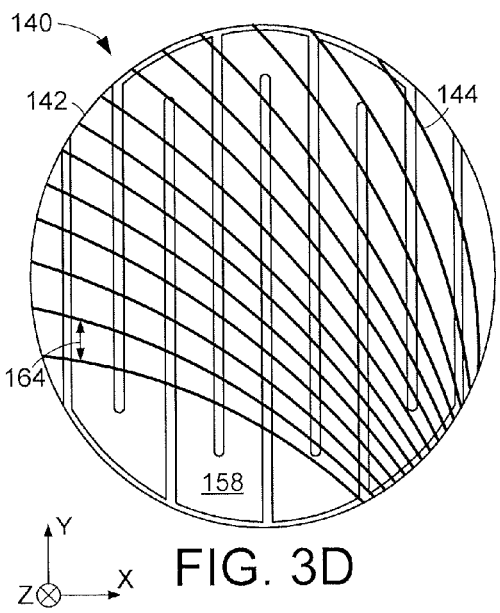

FIGS. 3A-3E respectively depict various portions of an example speaker 140 constructed and operated in accordance with assorted embodiments. A cross-sectional view of the speaker 140 in FIG. 3A shows a diaphragm 142 knurled to provide a multitude of ridges 144 that have a tuned shape and size relative to the first 146 and second 148 arrays of magnets.

While not limiting, the knurled ridges 144 can have a thickness 150, as measured along the Z axis, that continuously extends to a height 152 that is at least twice the thickness 150 of the diaphragm 142. That is, each knurled ridge 142 can extend from a plane 154 that dissects the thickness 150 to a height 152 that is two or more times the size of the diaphragm thickness 150. The knurled ridges 144 can be configured to maintain a minimum distance 156 from the magnets of the first 146 and second 148 arrays to allow ample diaphragm 142 excursion to replicate low frequency audio signals, such as below 200 Hz.

The position, shape, and size of the respective knurled ridges 144 can be tuned relative to the magnetic configuration of the various magnets of the respective arrays 146 and 148. For example, a knurled ridge 144 may be configured to be closer to magnets that are arranged with a S-N dipole while other knurled ridges 144 are positioned farther away from magnets having a N-S dipole or monopole magnetic arrangement. Thus, with no magnetic arrangement being required, the diaphragm 142 can be tuned with respect to the magnet arrays 146 and 148 to control diaphragm flex and distortion that may occur as a result of uniform, or varying, magnetic arrangements in the various magnets.

In the non-limiting embodiment of FIG. 3A, the knurled ridges 144 are positioned without contact with a voice coil trace. However, other embodiments can position one or more knurled ridges 144 in and around a voice coil trace, which may involve shaping the trace in a non-rectangular configuration. It is contemplated that a knurled ridge 144 can be positioned anywhere on the diaphragm 142 and continuously, or intermittingly, extend to partially, or completely, across the diaphragm 142. FIGS. 3B-3E respectively show top views of various knurled ridge configurations that can be employed individually and collectively to tune the flexibility and sound reproduction quality of the diaphragm 142.

FIG. 3B depicts a plurality of knurled ridges 144 arranged in a pattern to cross the voice coil trace 158 multiple times. The ridge pattern may be configured with uniform spacing between the ridges 144 throughout the ridge's respective lengths in the X-Y plane. Yet, different portions of the diaphragm 142 may be more prone to unwanted distortion and flexibility, which can be accommodated by configuring the ridge pattern with multiple different ridge spacing distances, as shown by distances 160 and 162.

It is noted that the ridge spacing distances are measured along the Y axis, but such measurement is not required and any measurement orientation can be used to describe uniform or non-uniform spacing between knurled ridges 144. It is also noted that in order for the knurl to maintain its form over time, the metal traces 158 must be stiffer than the underlying diaphragm 142 substrate material, lest the substrate restore the material to its prior, unknurled, form, which corresponds with the diaphragm 142 retaining only minor creases that negligibly increase speaker performance.

FIG. 3C provides an example knurled ridge 144 pattern with varying inter-ridge spacing in the X-Y plane. The various knurled ridges 144 are randomly positioned relative to one another and are confined to a predetermined portion of the diaphragm 142. That is, the right half portion of the diaphragm 142 has no knurled ridges 144 while the left half portion of the diaphragm 142 has numerous knurled ridges 144 that are randomly arranged. Such random ridge 144 configuration corresponds with ridges 144 crossing each other, which may produce a different ridge shape and/or size at the intersection of the ridges 144 than at other points along the length of each ridge 144.

FIG. 3D illustrates how knurled ridges 144 can be continuously curvilinear across the diaphragm 142. Various embodiments may utilize combinations of linear and curvilinear ridge 144 pathways across the diaphragm 142, but the non-limiting embodiment of FIG. 3D shapes the various knurled ridges 144 with different radii of curvature. It is contemplated that the continuously curvilinear ridge 144 pathways provide varying ridge spacing distances 164 that can be manipulated to tune the structure and operation of the diaphragm 142. In some embodiments, the knurled ridges 142 have a common origin point on the diaphragm 142, which may correspond with a portion of the diaphragm 142 free of an operational voice coil trace 158.

Figure 3E:
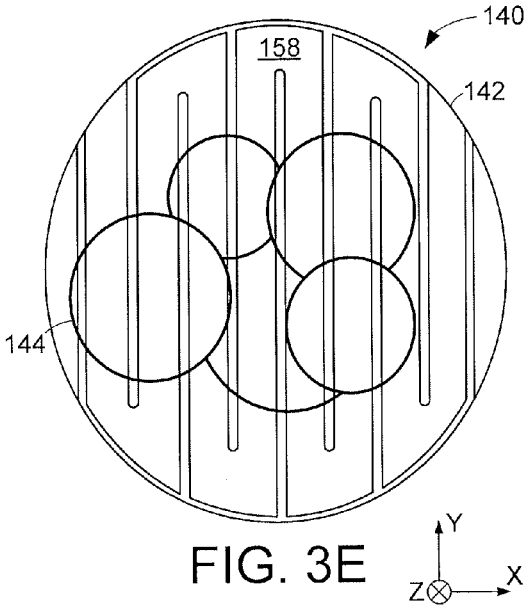

FIG. 3E displays another knurled ridge 144 pattern. The pattern has a plurality of concentric circles that do not extend to the outer periphery of the diaphragm 142. The various concentric circles may be ovals or any other shape, such as a rhomboid or triangle, that form a loop with each knurled ridge 144. The ability to configure a knurled ridge 144 into a shape can allow the diaphragm 142 to be knurled similarly to a bullseye with concentric circles having a common origin. In the non-limiting embodiment shown in FIG. 3E, the multiple different circle diameters and overlapping ridges 144 can create sophisticated diaphragm 142 tuning and flexibility control.

It is to be understood that while the various knurled ridge 144 patterns of FIGS. 3B-3E are shown in isolation, any aspect of any embodiment can coexist on a single diaphragm 142. For example, a concentric circle can be positioned with any number of linear ridges 144 that may or may not overlap the circle. Regardless of whether or not multiple different ridge 144 patterns are utilized, different ridges 144 in a single pattern may have different shapes and/or sizes. For instance, a first ridge 144 may be knurled with a triangular shape, as shown in FIG. 3A, and a second ridge 144 can have a rectangular or circular cross-sectional shape.

Figure 4A:
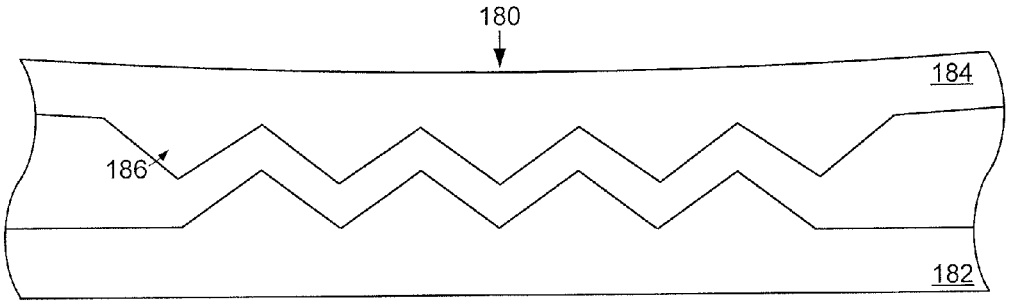
Figure 4B:
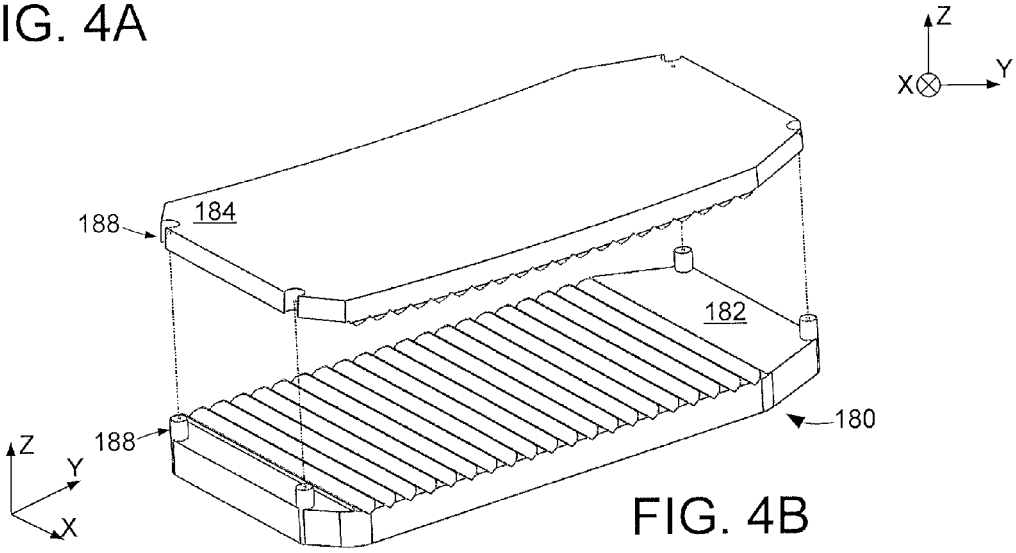

FIGS. 4A & 4B respectively provide line representations of portions of an example knurling device 180 that can be employed in accordance with some embodiments to create one or more knurled ridges. Although a diverse variety of equipment can manipulate a diaphragm to construct a knurled ridge, such as a rotating knurling tool, a diaphragm can be efficiently contorted to provide multiple shaped ridges by being pressed between first 182 and second 184 knurling plates. Each plate 182 and 184 can be constructed of any material, such as metals, polymers, ceramics, and combinations thereof, that mate with any number of protrusions 186 to manipulate a flexible diaphragm to permanently construct at least one knurled ridge corresponding with the shape of the protrusions 186.

In accordance with a non-limiting embodiment, the first plate 182 has a substantially linear body while the second plate 184 has a curved body that is conducive to applying increased amounts of pressure as the second plate 184 across the protrusions 186 of the first plate 182. FIG. 4B displays how the respective plates 182 and 184 can be configured to mechanically mate via securing features 188 that align along the Z axis. The securing features 188 can allow the plates 182 and 184 to remain interconnected while pressure is applied to one, or both, plates 182 and 184 without disturbing a diaphragm positioned there between.

The various protrusions 186 are shown to be similar sizes and shapes on each plate 182 and 184. Such arrangement is not required or limiting as a knurling plate 182 and 184 can have multiple different protrusion configurations. FIGS. 5A-5D respectively depict cross-sectional line representations of different knurling device 200 configurations that can be utilized individually and concurrently on a single knurling plate or device in accordance with assorted embodiments. The example knurling device 200 of FIG. 5A has bottom 202 and top 204 knurling plates each having protrusions 206 defined by a continuously curvilinear sidewalls 208 that meet at a point 210.

Figure 5A:
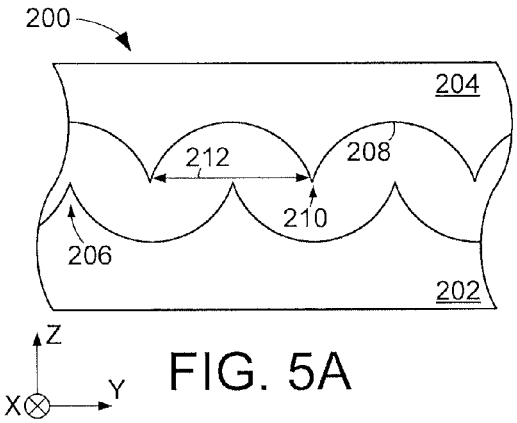
FIGS. 5A-5D respectively convey line representations of portions of an example knurling device arranged in accordance with some embodiments.
Figure 5B:
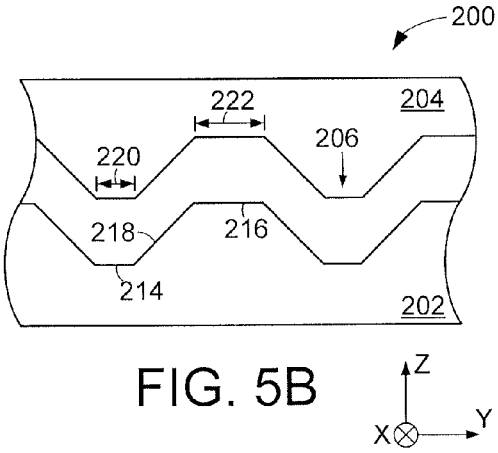

The various protrusions 206 of FIG. 5A can be tuned for height along the Z axis and width 212 along the Y axis between points 210 to control the aggressiveness of the knurled ridges the knurling device 200 can produce. The various points 210 can be rounded, in some embodiments, to mitigate the risk of puncturing or tearing a diaphragm or breaking a metal trace during a knurling process. Turning to FIG. 5B, the protrusions 206 of the knurling plates 202 and 204 are configured with continuously linear valley 214 and peak 216 surfaces that are each aligned along the Y axis and connected by a linear sidewall 218. The widths 220 and 222 of the respective valley 214 and peak 216 surfaces along the Y axis can be tuned to produce more, or less, aggressive knurled ridges.

Figure 5C:
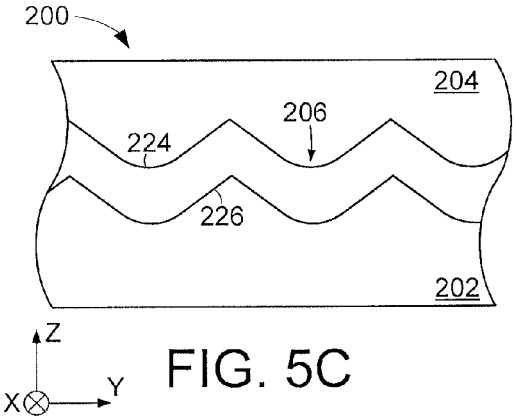
Figure 5D:
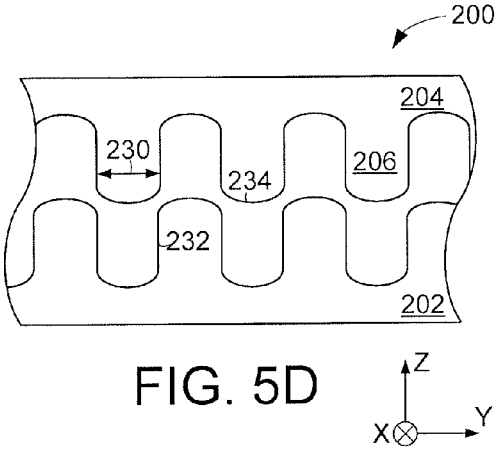

FIG. 5C illustrates how a knurling protrusion 206 can consist of a combination of curvilinear 224 and linear 226 surfaces to provide different peak and valley ridge shapes. Configuring a knurled ridge with curvilinear valleys and linear peaks can precisely tune diaphragm performance that cannot be produced by exclusively linear, or exclusively curvilinear, protrusion 206 defining surfaces. The protrusions 206 of FIG. 5D display how any shape and size can be utilized to form a knurled ridge. The finger protrusions 206 of FIG. 5D have a width 230, linear sidewalls 232, and continuously curvilinear mating surfaces 234 that interconnect to provide a diaphragm texture that can mitigate distortion, unwanted resonance, and inadvertent flexing.

With the nearly unlimited variety of knurling protrusion 206 shapes and sizes that can be provided by the knurling device 200, it is noted that the material construction of the diaphragm is tantamount to the ability of the knurling device 200 to provide optimized diaphragm performance. In other words, an overly thin and/or incompatible material can be rendered inoperable if subjected to the various aggressive knurling protrusions 206 of FIGS. 5A-5D that produce knurled ridges extending at least twice as high as the thickness of the diaphragm. Hence, the knurling device 200, knurled ridge pattern, and knurling protrusion 206 shape are tuned in concert to provide a diaphragm with increasingly robust flexibility and optimized sound reproduction performance. In general, the metal traces should be materially stiffer than the underlying substrate to ensure the shape of the knurled ridges is preserved over time.

Figure 6:
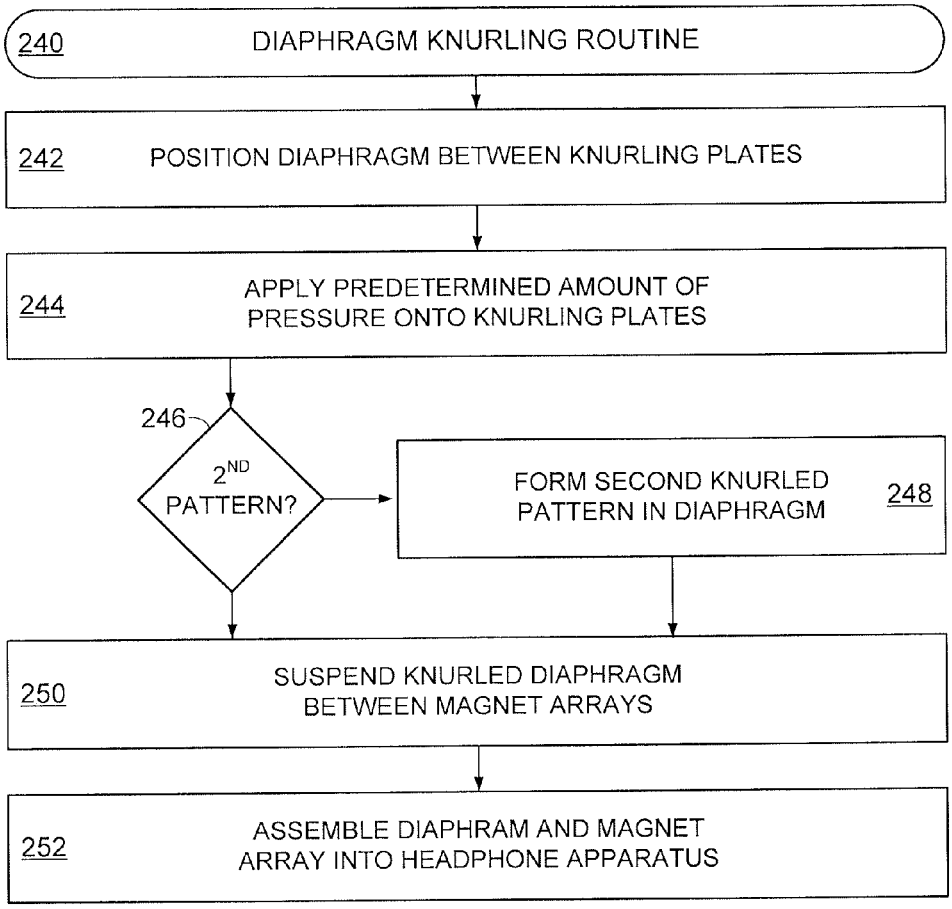
FIG. 6 provides an example diaphragm knurling routine carried out in accordance with assorted embodiments.

FIG. 6 is a flowchart of an example diaphragm knurling routine 240 this is carried out in accordance with various embodiments to manufacture a hearing device, such as a headphone, loudspeaker, or in-ear monitor. Initially, step 242 positions a diaphragm between knurling plates. The diaphragm has a continuously uniform, or varying, thickness and is constructed of a non-magnetic, electrically insulating material, like PET. One or more predetermined amounts of pressure are applied onto the diaphragm in step 244 by knurling plates of a knurling device to permanently imprint a knurled ridge pattern onto selected portions of the diaphragm.

While a single knurled ridge pattern may be employed by the diaphragm, various embodiments can utilize one or more additional knurled ridge patterns. Decision 246 evaluates if an additional knurled ridge pattern is to be imprinted on the diaphragm. If a second pattern is called for, step 248 proceeds to form a second knurled pattern in the diaphragm. It is contemplated that the second knurled ridge pattern is provided by changing one, or both, knurling plates used in the execution of step 244. At the conclusion of step 248, or in the event that decision 246 chooses not to employ an additional knurled ridge pattern, step 250 suspends the knurled diaphragm between top and bottom magnet arrays with tuned tension.

Step 250 may further consist of tuning the individual magnets of at least one magnet array to provide a predetermined magnetic profile. For instance, magnets of a magnet array can be rotated so that the poles facing the diaphragm present a non-uniform polarity. With the diaphragm suspended between magnet arrays in a planar magnetic assembly, step 252 next assembles the planar magnetic assembly into a hearing device by incorporating the assembly into a housing, which may be any size, shape, type, and purpose. As such, the planar magnetic assembly can provide sound reproduction for portable apparatus, like headphones and in-ear monitors, as well as for fixed apparatus, such as loudspeakers and floor standing monitors.

Through the various steps and decision of routine 240, a diaphragm can be tuned with one or more knurled ridges that optimize rigidity and mitigate unwanted resonance and distortion. However, the various aspects shown in FIG. 6 are not required or limiting as anything can be changed and removed just as anything can be added. For example, one or more steps and decisions may be added to manufacture at least one voice coil trace onto the diaphragm in a selected pattern with a selected material, such as copper, that has a density and elasticity that can utilize the aggressive knurled ridges with a height that is at least twice as big as the thickness of the diaphragm.

Figure 7A:
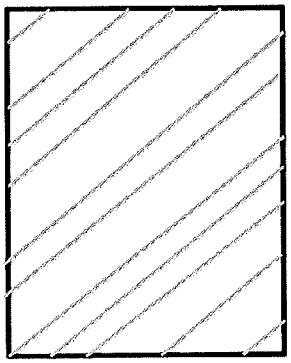
FIGS. 7A-7C respectively are top view line representations of portions of an example diaphragm arranged in accordance with various embodiments.
Figure 7B:
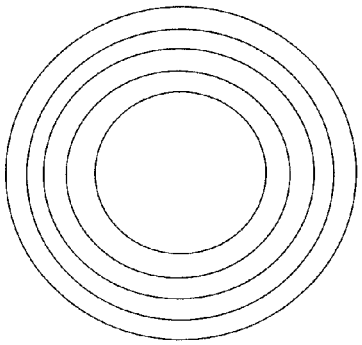
Figure 7C:
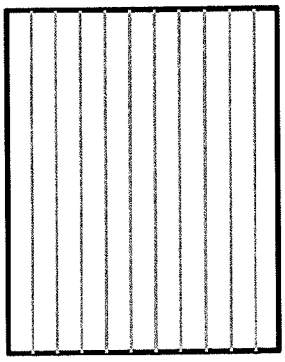

In FIGS. 7A-7C, various knurled ridge patterns are shown that can be implemented on portions of a diaphragm. The tuned shape, size, and pattern of the knurled ridges, as well as the knurling plates utilized to create the ridge pattern, can increase the compliance of the diaphragm, which optimizes bass response and transient performance. Greater diaphragm compliance corresponds with a smaller diaphragm physical size more readily responding to audio signal inputs to more accurately exert to reproduce low audio frequencies. Such increased compliance also reduces the space, weight, cost, and amplification requirements for reproducing high audio frequencies.

The tuning of knurled ridges in a diaphragm can significantly reduce distortion by allowing the diaphragm to move in a more ideal "flat piston" manner, which contrasts bowing or complex nonlinear diaphragm movements that are less ideal at accurately reproducing sound. The ability to provide flat piston movement can be particularly helpful in headphones with closed or semi-closed backs where diaphragm oscillations can produce resonances that degrade upper-bass and lower-midrange audio frequency reproductions.

The forming of the knurled ridges into the diaphragm can add a bit of surface area that equalizes diaphragm tension and improves consistency in diaphragm movement. For example, when a diaphragm is slightly tighter than desired before knurling and after knurling aggressive ridges, the substrate has been stretched to a larger size and a more relaxed tension, which contrasts a slightly too-relaxed diaphragm that will stretch less and will be slightly tightened due to the metal holding the diaphragm.

With the various embodiments of the present disclosure, it can be appreciated that a knurling device can be tuned to provide any knurled ridge geometry and pattern. A knurled ridge may continuously extent across all or part of a diaphragm and multiple ridge may be equally spaced from one another or have variable spacing. It is contemplated that knurled ridges have less aggressive heights and shapes proximal the edge of the diaphragm to mitigate potential diaphragm material failures.

As a non-exhaustive summary of some embodiments of the present disclosure, constructing voice coil traces of materials, like Cu and other materials with sufficient thickness to maintain a knurled for, with preferred combinations of density and elasticity allows thicker traces to be formed and deeper, more "aggressive" knurled ridges to be created compared to trace materials, like Al. Trace materials like copper allows a plethora of different knurled ridge shapes and sizes to be imprinted on the diaphragm to increase diaphragm compliance while reducing the resonant frequency. Such optimized diaphragm performance can be applied to legacy planar magnetic diaphragms to reduce distortion and enhance low frequency audio reproduction.

The ability to imprint any number of different knurled ridge patterns onto a diaphragm allows knurling to take place before, or after, formation of voice coil traces on the diaphragm. It is to be understood that even though numerous characteristics and configurations of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed. For example, the particular elements may vary depending on the particular application without departing from the spirit and scope of the present technology.

What is claimed is:

1. An apparatus comprising a diaphragm positioned proximal to and separated from a first array of magnets, the diaphragm comprising a substrate attached to at least one patterned electrically conductive trace, a portion of the diaphragm knurled to provide a ridge extending a height above the diaphragm that is at least twice a thickness of the diaphragm.

2. The apparatus of claim 1, wherein the diaphragm is disposed between first and second arrays of magnets.

3. The apparatus of claim 1, wherein the at least one patterned electrically conductive trace continuously extends across the ridge.

4. The apparatus of claim 1, wherein the diaphragm is incorporated into a portable headphone.

5. The apparatus of claim 1, wherein a first patterned conductive trace is attached to a first side of the diaphragm and a second patterned conductive trace is attached to a second side of the diaphragm.

6. The apparatus of claim 1, wherein the at least on electrically conductive trace has a non-rectangular shape proximal the ridge.

7. The apparatus of claim 1, wherein the diaphragm comprises polyethylene terephthalate material.

8. The apparatus of claim 1, wherein the ridge is positioned closer to a first magnet of the first array of magnets than a second magnet of the first array of magnet, the first magnet having a S-N dipole and the second magnet having a N-S dipole.

9. The apparatus of claim 1, wherein the diaphragm has a varying thickness along its length, the length extending parallel to the first array of magnets.

10. An apparatus comprising a diaphragm positioned proximal to and separated from a first array of magnets, the diaphragm comprising a substrate attached to at least one patterned electrically conductive trace, a portion of the diaphragm knurled to provide a plurality of ridges each extending a height above the diaphragm that is at least twice a thickness of the diaphragm, the thickness measured from a plane dissecting the diaphragm towards the first array of magnets, the thickness and height being parallel.

11. The apparatus of claim 10, wherein the plurality of ridges are arranged into a pattern with uniform spacing between first and second ridges.

12. The apparatus of claim 10, wherein the plurality of ridges are arranged with at least one intersecting ridge.

13. The apparatus of claim 10, wherein at least one ridge of the plurality of ridges has a continuously curvilinear shape on the diaphragm.

14. The apparatus of claim 10, wherein at least one ridge of the plurality of ridges has a circular shape on the diaphragm.

15. The apparatus of claim 10, wherein a first ridge of the plurality of ridges has a different cross-sectional shape than a second ridge of the plurality of ridges.

16. The apparatus of claim 10, wherein the at least one electrically conductive trace is materially stiffer than the diaphragm.

17. The apparatus of claim 10, wherein a first ridge has a triangular cross-sectional shape.

18. A method comprising:

positioning a diaphragm proximal to and separated from a first array of magnets, the diaphragm comprising a substrate attached to at least one patterned electrically conductive trace; and knurling a portion of the diaphragm to provide a ridge extending a height above the diaphragm that is at least twice a thickness of the diaphragm.

19. The method of claim 18, wherein the diaphragm is knurled by being pressed between first and second plates respectively having first and second knurling patterns.

20. The method of claim 19, wherein the diaphragm is subsequently knurled by being pressed between third and fourth plates respectively having third and fourth knurling patterns, the first, second, third, and fourth knurling patterns each being different.

* * * * *